US011830373B2

(12) United States Patent
Chaubey et al.

(10) Patent No.: US 11,830,373 B2
(45) Date of Patent: Nov. 28, 2023

(54) SYSTEMS AND METHODS FOR ALERTING DESCENT BELOW ALTITUDE

(71) Applicant: HONEYWELL INTERNATIONAL INC., Charlotte, NC (US)

(72) Inventors: Rajesh Chaubey, Bangalore (IN); Ratan Khatwa, Redmond, WA (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/647,179

(22) Filed: Jan. 6, 2022

(65) Prior Publication Data

US 2023/0089086 A1 Mar. 23, 2023

(30) Foreign Application Priority Data

Sep. 20, 2021 (IN) ..... 202111042480

(51) Int. Cl.

*G08G 5/04* (2006.01)
*G08G 5/00* (2006.01)
*G08G 5/02* (2006.01)

(52) U.S. Cl.

CPC ..... *G08G 5/045* (2013.01); *G08G 5/003* (2013.01); *G08G 5/0021* (2013.01); *G08G 5/0086* (2013.01); *G08G 5/025* (2013.01)

(58) Field of Classification Search

CPC ..... G08G 5/045; G08G 5/0021; G08G 5/003; G08G 5/0086; G08G 5/025

See application file for complete search history.

(56) References Cited

U.S. PATENT DOCUMENTS

| | | | |
|---|---|---|---|
| 4,224,669 | A | 9/1980 | Brame |
| 6,088,634 | A | 7/2000 | Muller et al. |
| 6,456,940 | B1 | 9/2002 | Higgins |
| 6,995,690 | B1 | 2/2006 | Chen et al. |
| 7,209,052 | B2 | 4/2007 | Artini et al. |

(Continued)

FOREIGN PATENT DOCUMENTS

| | | | |
|---|---|---|---|
| GB | 2043388 | A | 10/1980 |
| JP | 2008102588 | A | 5/2008 |

OTHER PUBLICATIONS

Eurocontrol, "Eurocontrol Guidance Material for Minimum Safe Altitude Warning Appendix A: Reference MSAW System," Edition No. 1.0, dated May 19, 2009.

*Primary Examiner* — Curtis A Kuntz
*Assistant Examiner* — James E Munion
(74) *Attorney, Agent, or Firm* — Lorenz & Kopf LLP

(57) ABSTRACT

Methods and system for alerting descent with respect to at least one of minimum sector altitude, minimum safe altitude and terrain clearance floor in an aircraft. The methods and systems receive at least one of a minimum sector altitude value, a minimum safe altitude value and a terrain clearance floor value based on a flight plan of the aircraft or a location of the aircraft. A movement trajectory of the aircraft is predicted. The aircraft predicted movement trajectory is evaluated with respect to the at least one of the minimum sector altitude value, the minimum safe altitude value and the terrain clearance floor value. An alert is output when the evaluation predicts convergence of the aircraft predicted movement trajectory and the at least one of the minimum sector altitude value, the minimum safe altitude value and the terrain clearance floor value.

20 Claims, 8 Drawing Sheets

(56) References Cited

U.S. PATENT DOCUMENTS

| | | | | |
|---|---|---|---|---|
| 7,493,197 | B2 | 2/2009 | Bitar et al. | |
| 7,881,867 | B2 | 2/2011 | Lorido et al. | |
| 8,032,268 | B2 | 10/2011 | Burgin et al. | |
| 8,514,105 | B1 | 8/2013 | Spencer, V et al. | |
| 8,583,368 | B1 | 11/2013 | Sindlinger et al. | |
| 8,897,935 | B2 * | 11/2014 | Meunier | G05D 1/0676 340/948 |
| 8,972,082 | B2 * | 3/2015 | Pepitone | G08G 5/0021 701/4 |
| 9,354,078 | B2 | 5/2016 | Burgin et al. | |
| 10,577,123 | B1 | 3/2020 | Kirtz et al. | |
| 2005/0261811 | A1 | 11/2005 | Artini et al. | |
| 2007/0250223 | A1 * | 10/2007 | Francois | G08G 5/0086 701/9 |
| 2010/0082186 | A1 * | 4/2010 | Burgin | G01C 23/00 701/9 |
| 2018/0275651 | A1 | 9/2018 | Prosser | |
| 2019/0130772 | A1 | 5/2019 | Pinchon | |
| 2019/0162555 | A1 | 5/2019 | Youssef | |

* cited by examiner

SYSTEMS AND METHODS FOR ALERTING DESCENT BELOW ALTITUDE

CROSS REFERENCE TO RELATED APPLICATION

This application claims priority to India Provisional Patent Application No. 202111042480, filed Sep. 20, 2021, the entire content of which is incorporated by reference herein.

TECHNICAL FIELD

The subject matter described herein relates to the provision of alerts for descent below a certain altitude.

BACKGROUND

A ground proximity warning system (GPWS) is a system designed to alert pilots if their aircraft is in immediate danger of flying into the ground or an obstacle. A traditional GPWS gathers data from directly below an aircraft using a radio altimeter. Improvements relating to traditional GPWS have been made, named "Enhanced Ground Proximity Warning System" (EGPWS). EGPWS combines a worldwide digital terrain database and Global Positioning System (GPS) technology. The EGPWS computer compares current location with data from the database of the Earth's terrain. A Terrain Display (TD) provides pilots a visual orientation to high and low points nearby the aircraft. The Terrain Clearance Floor (TCF) function alerts the pilot of descent below a defined Terrain Clearance Floor regardless of the aircraft configuration. TCF alerts may result in illumination of the EGPWS caution lights and the aural message "TOO LOW TERRAIN" (for example). The EGPWS caution lights remain on until TCF envelopes are exited.

It is desirable to provide methods and systems providing greater lead time in advance of any descent below altitude events. Additionally, it is desirable to provide displays enabling enhanced situation awareness for the flight crew about such events. Furthermore, other desirable features and characteristics of the present invention will become apparent from the subsequent detailed description and the appended claims, taken in conjunction with the accompanying drawings and the foregoing technical field and background.

BRIEF SUMMARY

In one aspect, a method for alerting descent with respect to at least one of minimum sector altitude, minimum safe altitude and terrain clearance floor in an aircraft, the method comprising: receiving, via at least one processor, at least one of a minimum sector altitude value, a minimum safe altitude value and a terrain clearance floor value based on a flight plan of the aircraft or a location of the aircraft; predicting, via the at least one processor, a movement trajectory of the aircraft; evaluating, via the at least one processor, the aircraft predicted movement trajectory with respect to the at least one of the minimum sector altitude value, the minimum safe altitude value and the terrain clearance floor value; and outputting an alert, via an output system, when the evaluation predicts convergence of the aircraft predicted movement trajectory and the at least one of the minimum sector altitude value, the minimum safe altitude value and the terrain clearance floor value.

In embodiments, predicting the movement trajectory of the aircraft is based on modelling a vertical descent path. The vertical descent path is modelled based on vertical speed of the aircraft.

In embodiments, predicting the movement trajectory of the aircraft is based on aircraft state data and is performed, at least partly, by a Flight Management System (FMS) of the aircraft.

In embodiments, predicting the movement trajectory of the aircraft comprises: receiving, via the at least one processor, a rate of descent of the aircraft; using the rate of descent of the aircraft, projecting, via the at least one processor, an altitude of the aircraft at a plurality of points along the movement trajectory; and receiving, via at least one processor, at least one of a minimum sector altitude value, a minimum safe altitude value and a terrain clearance floor value for each of the plurality of points along the movement trajectory; wherein evaluating the aircraft predicted movement trajectory comprises: comparing, via the at least one processor, the altitude of the aircraft at each of the plurality of points with the at least one of the minimum sector altitude value, the minimum safe altitude value and the terrain clearance floor value.

In embodiments, evaluating the aircraft predicted movement trajectory comprises determining an altitude error based on a difference between the altitude of the aircraft at each of the plurality of points and the at least one of the minimum sector altitude value, the minimum safe altitude value and the terrain clearance floor value.

In embodiments, the method comprises determining, via the at least one processor, a vertical acceleration required to avoid convergence of the aircraft predicted movement trajectory and the at least one of the minimum sector altitude value, the minimum safe altitude value and the terrain clearance floor value based on the rate of descent of the aircraft and the altitude error at each of the plurality of points, wherein evaluating the aircraft predicted movement trajectory comprises comparing the vertical acceleration required with vertical acceleration operational limits of the aircraft.

In embodiments, predicting the movement trajectory of the aircraft comprises: receiving, via the at least one processor, an altitude of the aircraft at a plurality of points along the movement trajectory from a Flight Management System (FMS) of the aircraft; and receiving, via at least one processor, at least one of a minimum sector altitude value, a minimum safe altitude value and a terrain clearance floor value for each of the plurality of points along the movement trajectory.

In embodiments, evaluating the aircraft predicted movement trajectory comprises: comparing, via the at least one processor, the altitude of the aircraft at each of the plurality of points with the at least one of the minimum sector altitude value, the minimum safe altitude value and the terrain clearance floor value.

In embodiments, evaluating the aircraft predicted movement trajectory comprises determining an altitude error based on a difference between the altitude of the aircraft at each of the plurality of points and the at least one of the minimum sector altitude value, the minimum safe altitude value and the terrain clearance floor value.

In embodiments, the method comprises determining, via the at least one processor, a vertical acceleration required to avoid convergence of the aircraft predicted movement trajectory and the at least one of the minimum sector altitude value, the minimum safe altitude value and the terrain clearance floor value based on a rate of descent of the aircraft and the altitude error at each of the plurality of points, wherein evaluating the aircraft predicted movement trajectory comprises comparing the vertical acceleration required with vertical acceleration operational limits of the aircraft.

In embodiments, outputting the alert includes outputting, via a display system of the output system, a visual indicator and/or outputting an aural alert via a speaker of the output system.

In embodiments, the visual indicator is coded to indicate a safe status when the evaluation predicts no convergence of the aircraft predicted movement trajectory with the at least one of the minimum sector altitude value, the minimum safe altitude value and the terrain clearance floor value and to indicate a caution or warning status when the evaluation predicts convergence of the aircraft predicted movement trajectory and the at least one of the minimum sector altitude value, the minimum safe altitude value and the terrain clearance floor value.

In embodiments, the visual indicator is coded to indicate a safe status when the evaluation predicts no convergence of the aircraft predicted movement trajectory with the at least one of the minimum sector altitude value, the minimum safe altitude value and the terrain clearance floor value, to indicate a caution status when the evaluation predicts convergence of the aircraft predicted movement trajectory and the minimum safe altitude value or the minimum sector altitude value and to indicate a warning status when the evaluation predicts convergence of the aircraft predicted movement trajectory and the terrain clearance floor value.

In embodiments, the method comprises deciding, via the at least one processor, whether to perform the evaluation with respect to minimum sector altitude or the minimum safe altitude based on the aircraft location or the aircraft predicted movement trajectory.

In another aspect, a system for alerting descent with respect to at least one of minimum sector altitude, minimum safe altitude and a terrain clearance floor in an aircraft is provided. The system comprises: an output system; at least one processor in operable communication with the output device, the processor configured to execute program instructions, wherein the program instructions are configured to cause the processor to: receive at least one of a minimum sector altitude value, a minimum safe altitude value and a terrain clearance floor value based on a flight plan of the aircraft or a location of the aircraft; predict a movement trajectory of the aircraft; evaluate the aircraft predicted movement trajectory with respect to the at least one of the minimum sector altitude value, the minimum safe altitude value and the terrain clearance floor value; and output an alert, via the output system, when the evaluation predicts convergence of the aircraft predicted movement trajectory and the at least one of the minimum sector altitude value, the minimum safe altitude value and the terrain clearance floor value.

In another aspect, a system for alerting descent with respect to at least one of minimum sector altitude, minimum safe altitude and a terrain clearance floor in an aircraft is provided. The system comprises an output system; at least one processor in operable communication with the output device, the processor configured to execute program instructions, wherein the program instructions are configured to cause the processor to: predict a movement trajectory of the aircraft, the movement trajectory including a plurality of spaced locations; receive at least one of a minimum sector altitude value, a minimum safe altitude value and a terrain clearance floor value based on a flight plan of the aircraft or a location of the aircraft for each of the plurality of spaced locations of the movement trajectory; evaluate the aircraft predicted movement trajectory with respect to the at least one of the minimum sector altitude value, the minimum safe altitude value and the terrain clearance floor value at each of the plurality of spaced location of the movement trajectory; and output an alert, via the output system, when the evaluation predicts convergence of the aircraft predicted movement trajectory and the at least one of the minimum sector altitude value, the minimum safe altitude value and the terrain clearance floor value.

In embodiments, predicting the movement trajectory of the aircraft is based on aircraft state data and is performed, at least partly, by a Flight Management System (FMS) of the aircraft.

In embodiments, predicting the movement trajectory of the aircraft takes into account constant vertical speed and an aircraft acceleration, to derive an altitude error at each of a plurality of points along a forthcoming flight plan.

In embodiments, outputting the alert includes outputting, via a display system of the output system, a visual indicator and/or outputting an aural alert via a speaker of the output system.

In embodiments, the visual indicator is coded to indicate a safe status when the evaluation predicts no convergence of the aircraft predicted movement trajectory with the at least one of the minimum sector altitude value, the minimum safe altitude value and the terrain clearance floor value and to indicate a caution or warning status when the evaluation predicts convergence of the aircraft predicted movement trajectory and the at least one of the minimum sector altitude value, the minimum safe altitude value and the terrain clearance floor value.

In embodiments, the visual indicator is coded to indicate a safe status when the evaluation predicts no convergence of the aircraft predicted movement trajectory with the at least one of the minimum sector altitude value, the minimum safe altitude value and the terrain clearance floor value, to indicate a caution status when the evaluation predicts convergence of the aircraft predicted movement trajectory and the minimum safe altitude value or the minimum sector altitude value and to indicate a warning status when the evaluation predicts convergence of the aircraft predicted movement trajectory and the terrain clearance floor value.

In embodiments, the program instructions are configured to cause the processor to: decide whether to perform the evaluation with respect to minimum sector altitude or the minimum safe altitude based on the aircraft location or aircraft predicted forward trajectory (we can call as aircraft predicted movement trajectory).

In embodiments, the alert is a visual alert included in an altitude profile depicting the at least one of the minimum sector altitude value, the minimum safe altitude value and the terrain clearance floor value at a plurality of locations along the flight plan or aircraft predicted forward trajectory (we can call as aircraft predicted movement trajectory), wherein the altitude profile is color-coded to indicate convergence and non-convergence of the aircraft predicted movement trajectory and the at least one of the minimum sector altitude value, the minimum safe altitude value and the terrain clearance floor value. In some embodiments, the safe altitude profile may be integrated within a depiction of the actual terrain elevations along the aircraft predicted movement trajectory. In addition, similar information may be visually coded on 2D lateral Navigation Displays or a 3D Synthetic Vision Display.

In embodiments, the altitude profile includes a depiction of the flight plan or the aircraft predicted movement trajectory.

In embodiments, the alert is a visual alert included in a minimum sector altitude diagram included a color-coded region indicating where the evaluation predicts convergence of the aircraft predicted movement trajectory and the at least one of the minimum sector altitude value, the minimum safe altitude value and the terrain clearance floor value.

In embodiments, the alert is a visual alert included in a terrain display including a color-coded region indicating where the evaluation predicts convergence of the aircraft predicted movement trajectory and the at least one of the minimum sector altitude value, the minimum safe altitude value and the terrain clearance floor value.

In embodiments, the alert is a visual alert included in a primary flight display.

In embodiments, the alert includes a visual alert indicating convergence and lack of convergence at each of the plurality of spaced locations.

BRIEF DESCRIPTION OF THE DRAWINGS

Embodiments of the subject matter will hereinafter be described in conjunction with the following drawing figures, wherein like numerals denote like elements, and.

DETAILED DESCRIPTION

Figure 1:
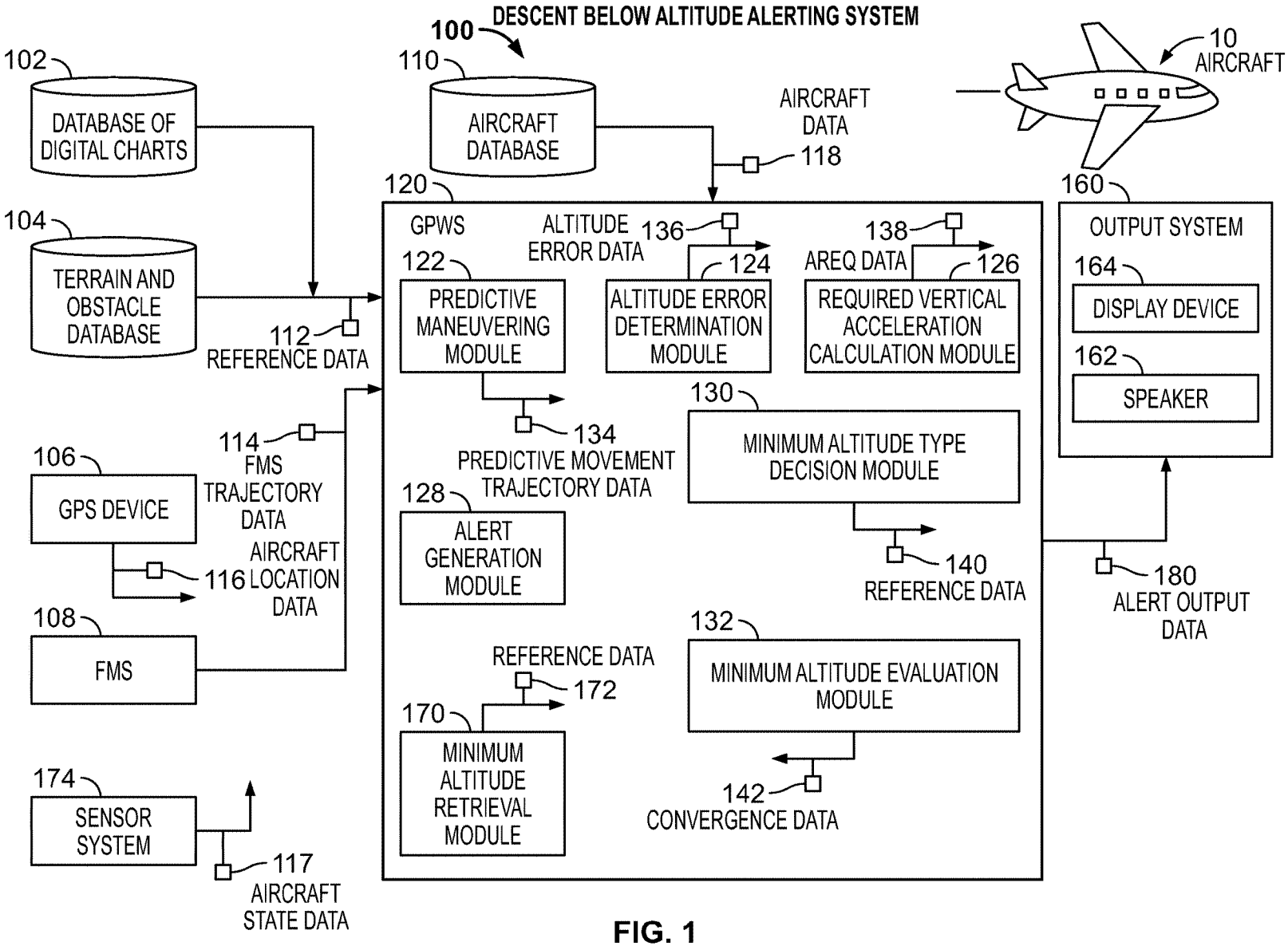
FIG. 1 is a block diagram of an aircraft system for descent below altitude alerts, in accordance with an exemplary embodiment.

Systems and methods described herein provide alerts of descent below minimum safe altitude, minimum sector altitude and Terrain Clearance Floor (TCF). The systems and methods provide awareness and alerting to the flight crew of a predicted premature descent below the minimum sector altitude (in terminal area) and minimum safe altitude (during approach). The systems and methods use a blended solution of Flight Management System (FMS) functions and data and Enhanced Ground Proximity Warning System (EGPWS) functions and data to extend capabilities of Ground Proximity Warning Systems (GPWS) with respect to premature descent.

In embodiments, lateral and vertical trajectories of the aircraft are predicted by the FMS and minimum altitudes (to be maintained) along the predicted trajectories are obtained from digital flight charts and other data sources. The predicted vertical trajectory and the minimum altitudes are used to predict premature descent. The minimum altitudes include minimum safe altitude, minimum sector altitude and TCF. Rather than relying on actual descent below the minimum altitudes (reactive) prior to alerting, the systems and methods of the present disclosure predicts a premature descent below minimum altitude, providing an enhancement to alerting functionality. The predictive solution provides flight crew with greater lead time in which to react to descent below alerts.

The descent below alerts can be in the form of aural alerts and visual alerts. In one example, the visual alert is included in a vertical situation display (VSD) indicating premature descent on approach. Further, a descent below minimum sector altitude can be included on a Navigation Display (ND) or a Synthetic Vision Display. The visual alerts can be color-coded to indicate convergence and lack of convergence with respective minimum altitudes.

In embodiments, systems and processes disclosed herein generate aircraft lateral and/or vertical trajectory for a given flight plan or vectoring situation and evaluate a possibility for minimum altitude deviation along the trajectory. The minimum altitude deviation computation can be made by deciding, based on a location of the aircraft, whether to compute deviation with respect to minimum sector altitude, minimum safe altitude or terrain clearance floor. The systems and methods identify the minimum altitudes at a plurality of points of interest along the aircraft trajectory. The aircraft predicted movement trajectory or aircraft forward predicted trajectory is evaluated at each point of interest against the minimum altitude for that point of interest, which may include determining an altitude error therebetween. The minimum altitude and its type are derived (e g minimum Sector or Safe altitude or TCF altitude). Caution alerts may be provided when the aircraft is predicted to converge with the minimum safe or sector altitudes and warning alerts may be provided when the aircraft is predicted to converge with the TCF altitudes.

The visual alerts may be incorporated into a terrain depiction, an ND, a VSD or a Primary Flight Display (PFD) or any combination thereof. The visual alerts may depict spatially representative regions on an ND, VSD or other display system of convergence with the minimum altitudes for pilot awareness. The visual alert may be included in a minimum sector altitude diagram. In some embodiments, color coding is used to depict the visual alerts. One color (e.g. GREEN) can be used to depict that the aircraft is not predicted to have a maneuvering trajectory conflicting with the minimum altitude. Another color (e.g. amber or red) can be used when the aircraft is conflicting with the minimum altitude.

FIG. 1 depicts an exemplary embodiment of a system 100 for alerting descent below altitude that is associated with an aircraft 10. The illustrated system 100 includes a Ground Proximity Warning System (GPWS) 120 operably coupled to digital charts 102 stored in a database, a terrain and obstacle database 104, a GPS device 106, a Flight Management System (FMS) 108 and an output system 160. The system 100, and particularly the GPWS 120, are implemented by a processing system 1006 as described in further detail below with respect to FIG. 10. The processing system 1006 executes programming instructions to evaluate a predicted flight trajectory for the aircraft 10 with respect to minimum altitudes and to generate a descent below alert based on the evaluation. It should be appreciated that FIG.

1 is a simplified representation of the system 100 associated with an aircraft 10 for purposes of explanation and is not intended to limit the subject matter in any way. In this regard, it will be appreciated that, in practice, the system 100 onboard the aircraft 10 may include any number of different onboard systems configured to support operation of the aircraft 10, and the subject matter described herein is not limited to any particular type or number of onboard systems.

The GPWS 120 relates position of the aircraft 10, which is derivable from aircraft location data 116 from the GPS device 106, to georeferenced terrain and obstacle datasets available from the terrain and obstacle database 104. The GPS device 106 can be internal to the GPWS 120 or coupled to the FMS 108. The terrain and obstacle database 104 provides a digital representation of terrain and obstacles to a series of airborne and ground applications including the GPWS 120. The GPWS 120 can provide other aircraft state data useful in the calculations performed by the descent below altitude alerting system 100. The terrain and obstacle database 104, which can be internal or external to the GPWS 120, provides a terrain dataset that is a digital representation of the elevation of the terrain at discrete points. Exemplary features of a terrain database include geometric distribution/position of discrete points, horizontal/vertical datum and specific units of measurement. The terrain database describes the surface of the Earth containing naturally occurring features such as mountains, hills, ridges, valleys, bodies of water, permanent ice and snow. The terrain and obstacle database 104 further provides an obstacle dataset, which is a digital representation of obstacles including horizontal and vertical extent of man-made and natural significant features. Obstacles include fixed (whether temporary or permanent) and mobile objects, or parts thereof, that are located in an area intended for the surface movement of aircraft, or extend above a defined surface intended to protect aircraft in flight, or stand outside those defined surfaces and that have been assessed as being a hazard to air navigation. The GPWS 120 provides indications of potential contact with the ground for conditions including excessive rates of descent, excessive closure rate to terrain, etc.

In accordance with the present disclosure, the terrain and obstacle database 104 and/or the database of digital charts 102 provides reference data 112 describing a variety of minimum altitudes that are evaluated by the GPWS 120 in generating descent below altitude alerts. One exemplary minimum altitude is minimum safe altitude, which denotes an altitude below which it is unsafe to fly owing to presence of terrain or obstacles. Minimum safe altitudes are calculated in relation to the highest terrain or obstacle within a specified area, allowing a buffer for error, and adding a specified margin. Another example minimum altitude is minimum sector altitude or terminal arrival altitude, which are established for each aerodrome and provide at least 300 m (1000 ft) obstacle clearance within 46 km (25 NM) of a navigation aid, initial approach fix, or intermediate fix associated with the approach procedure for that aerodrome. Another minimum altitude is the Terrain Clearance Floor (TCF), which is defined relative to each runway and provides an accurate altitude versus distance description of the TCF around the runway. Comprehensive aircraft position and navigation information from the FMS 108 and/or the GPS device 106 are used to assess proximate runways and to pick a most likely destination runway for TCF alerting purposes. The GPWS 120 may implement a runway picker algorithm used to determine the most likely runway that the aircraft 10 is lined-up with.

Generally, the GPWS 120 generates a visual and audio caution or warning alert when a determination is made as to terrain or obstacle conflicts. The GPWS 120 includes an alert generation module 128 that generates the audible and visual caution alerts. In embodiments, the alert generation module includes a Terrain Alerting and Display (TAD) that provides a graphic display of the surrounding terrain on a display device 164 of the output system 160. The display device 164 can be a weather radar indicator, an electronic flight information system, or a dedicated display. Based on the aircraft's position and terrain and obstacle datasets from the terrain and obstacle database 104, the terrain and obstacle topography (within the display range selected and possibly filtered for a certain vertical range relative to an altitude of the aircraft) is presented on the display device 164. The alert generation module 128 colors a relevant part of the terrain (or obstacle) a first color (e.g. amber) as part of a caution alert and may color a relevant part of the terrain (or obstacle) a second color (e.g. red) as part of a warning alert. This coloring scheme may be provided as a supplement to other visual alerting on other display devices such as textual notifications and graphical coloring and warning or caution lights and is additional to aural terrain warning and caution alerts. Exemplary visual alerts generated by the alert generation module 128 are described in greater detail below with respect to FIGS. 2 to 8.

In the embodiment of FIG. 1, the GPWS 120 includes a minimum altitude type decision module 130. The minimum altitude type decision module 130 determines which type of minimum altitude is to be assessed based on the current aircraft location included in the aircraft location data 116 and a planned (or predicted) forthcoming path of the aircraft 10. In particular, the minimum altitude type decision module 130 determines whether minimum sector altitudes or minimum safe altitudes should be assessed at each of a plurality of points (e.g. waypoints or fixes) along the predicted movement trajectory (forward predicted trajectory) of the aircraft 10. In embodiments, the minimum altitude type decision module transitions from assessing minimum safe altitudes to minimum sector altitudes when the aircraft passes a distance of 46 km (25 NM) of a navigation aid, passes an initial approach fix, or passes an intermediate fix associated with an approach procedure for a target aerodrome based on data available from the database of digital charts 102, the aircraft location data 116, data available from the FMS 108 and/or GPWS 120. The target aerodrome is known from a flight plan provided by the FMS 108, and the initial approach fix or the intermediate fix can be derived from digital chart data provided by the FMS 108 or the database of digital charts 102. Outside of the distance of 46 km (25 NM) from the navigation aid, the initial approach fix, or the intermediate fix, the minimum safe altitudes are utilized for subsequent processing by the GPWS 120. The minimum altitude type decision module 130 first outputs minimum altitude type data 140 representing the decision of whether to evaluate minimum safe or minimum sector altitude values at a number of points along the aircraft forward predicted trajectory. The minimum altitude type decision module 130 finally outputs the minimum altitude type. These minimum altitude values are evaluated for conflicts at a number of points along the aircraft forward predicted trajectory. The aircraft forward predicted trajectory is available from the FMS 108 or from the predictive maneuvering module 122.

The FMS 108 is a specialized computer system that automates a wide variety of in-flight tasks, reducing the workload on the flight crew. A primary function is in-flight management of the flight plan. Using various sensors (such as GPS and often backed up by radio navigation) to determine the aircraft's position, the FMS 108 can guide the aircraft 10 along the flight plan. The FMS 108 can be configured to implement one or more flight mode(s), flight plans, etc. of the aircraft 10 selected by user input and display information associated with the one or more flight mode(s) on a display device 164 of the output system 160. In embodiments, a navigation function of the FMS 108 allows a route to be programmed by a user. A flight director (not shown) and an auto-pilot system (not shown) can steer the aircraft 10 along the desired course to an active waypoint. When the aircraft reaches an active waypoint, the FMS 108 automatically sequences to the next waypoint in the route, unless waypoint sequencing is suspended.

Figure 7:
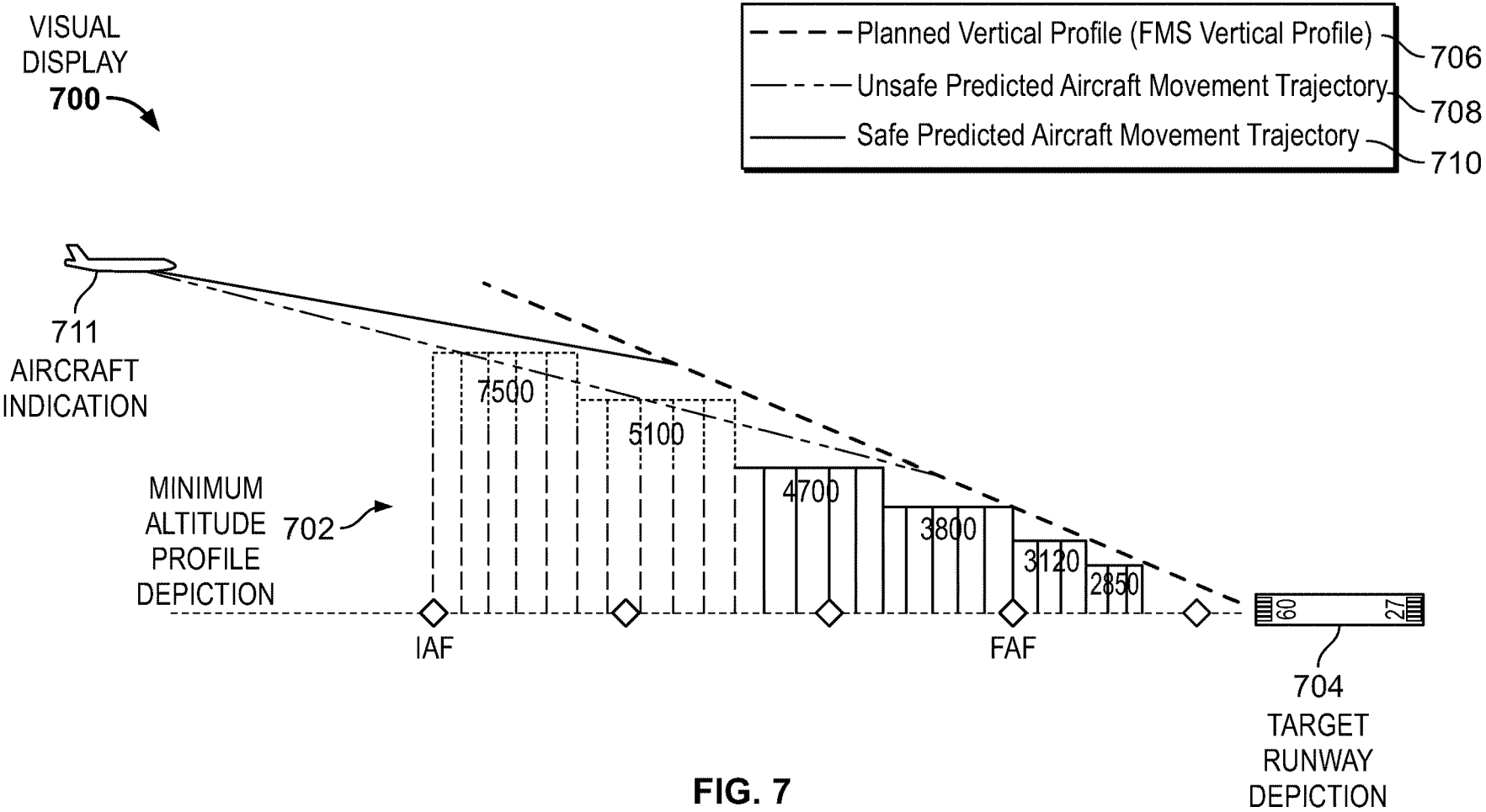
FIG. 7 depicts an exemplary graphical display including a visual alert of descent below altitude in minimum altitude format, in accordance with an exemplary embodiment.

The minimum altitude retrieval module 170 is responsive to the minimum altitude type data 140 to retrieve the minimum altitude of the safe or sector type that is to be used as the standard for determining whether the aircraft 10 is converging with the minimum altitude. The minimum altitude retrieval module 170 receives aircraft forward predicted trajectory, which may be provided by the FMS 108 or 122, describing a trajectory to a destination runway. The minimum altitude associated at the aircraft location or with each fix or waypoint or at a distance along an aircraft forward predicted trajectory is retrievable from the terrain and obstacle database 104 and/or the database of digital charts 102. In this way, minimum altitudes (whether safe or sector altitudes or TCF) at each location is provided for a forthcoming flight path of the aircraft 10. Referring to FIG. 7, an exemplary minimum altitude depiction 702 is depicted, which defines minimum altitudes that vary with distance from a current location of the aircraft 10 to a target runway 704. Although the present embodiment has been described in terms of approach procedures, a minimum altitude can be described for other phases of flight including take-off, go around procedures, etc. The depiction of the target runway 704 in FIG. 7 is notional and may be depicted in other ways.

The minimum altitude retrieval module 170 is further configured to obtain TCF minimum altitude values at the aircraft location or along the aircraft predicted movement trajectory. The TCF values are available from the terrain and obstacle database 104. According to embodiments of the present disclosure, the minimum safe or minimum sector altitude values provide a threshold below which a caution alert is issued and the TCF values provide a threshold below which a warning alert is issued. Accordingly, the minimum altitude retrieval module 170 will output minimum altitude data 172 describing varying minimum safe and/or minimum sector altitudes at the aircraft location or along the aircraft predicted movement trajectory and varying TCF values at the aircraft location or along the aircraft predicted movement trajectory.

The predictive maneuvering module 122 is configured to determine a realistic movement trajectory for the aircraft 10. In embodiments when predicted trajectory data 114 (e.g. describing a descent profile) is not available from the FMS 108, an aircraft rate of descent is obtained from the sensor system 174 providing aircraft state data 117. The aircraft rate of descent can also be calculated from a projection of the aircraft location data 116 from the GPS device 106. Assuming a constant rate of descent and interpolating a plurality of projected data points forward of the aircraft 10 based on aircraft horizontal speed (available from the aircraft state data 117), the altitude of the aircraft 10 at each of the projected data points can be predicted. For example, taking a point that is 2 seconds away from a current location of the aircraft 10 assuming the horizontal speed is maintained, the rate of descent (vertical speed) at that point is VS=h1−h2/2, where h1 is the current aircraft altitude and h2 is the altitude at the point 2 seconds away. This can be rearranged to obtain the aircraft altitude at the second point. An altitude profile of the aircraft 10 can thus be predicted by the predictive maneuvering module 122. In embodiments where forward predicted trajectory data 114 is available from the FMS 108, the predicted trajectory data 114 projects an altitude profile of the aircraft 10 along the track distance. The predictive maneuvering module 122 may interpolate further data points, if a finer data granularization is desired. Accordingly, the predictive maneuvering module 122 outputs an altitude versus distance profile describing a predicted altitude of the aircraft 10 at distributed points from a current aircraft location to a target runway (for example).

In embodiments, the predictive maneuvering module 122 includes functionality to model a vertical descent profile of the aircraft 10. For example, the vertical acceleration of the aircraft 10 can be derived from aircraft state data 117 and this can be used to plot a vertical descent profile for the aircraft 10. The altitude path can be calculated based on the vertical acceleration or one of many vertical descent profiles can be retrieved from memory, where each stored descent path varies based on the vertical acceleration of the aircraft 10. In this way, a continuous or finely discretized vertical descent profile can be evaluated with respect to the minimum altitudes. The results of the evaluation for a vertical descent profile are likely to better reflect the reality of the aircraft descent than a linear projection. In other embodiments, the vertical descent profile can be modeled in an indirect way, as will be described with respect to the required vertical acceleration calculation module 126.

In embodiments, the GPWS 120 includes an altitude error determination module 124 and a required vertical acceleration calculation module 126 that can be used in combination, or not, to provide an indication of conflict with the minimum altitudes defined in the minimum altitude data 172. The altitude error determination module 124 compares the predicted altitude profile of the aircraft 10 as defined in the aircraft predicted movement trajectory data 134 with the minimum altitudes defined in the minimum altitude data 172 to determine if there is any cause for alert based on the predicted aircraft altitude profile falling below one of the minimum altitudes. When a descent below minimum altitude is predicted, altitude error data 136 is output that describes which, and spatially specifies, minimum altitude is predicted to be breached. In some embodiments, the altitude error determination module 124 factors in an altitude tolerance above the minimum altitude (as defined in the foregoing) so that an alert is indicated when the predicted altitude profile is within the tolerance amount of the minimum altitude profile. The GPWS 120 further includes a required vertical acceleration calculation module 126 that calculates an acceleration required by the aircraft 10 to avoid intercept with the respective minimum altitudes. Whether that vertical acceleration is within performance capabilities of the aircraft 10 can be determined to assess whether an alert can be issued. The required vertical acceleration calculation module 126 calculates the required vertical acceleration (areq) based on the following equation 1:

$$areq = (\text{rate of altitude error or rate of vertical descent})^2/2 * \text{absolute}(\text{altitude error}) \quad \text{(equation 1)}$$

The altitude error is the difference between the minimum altitude value being evaluated and the current or predicted altitude of the aircraft 10. The rate of altitude error can be taken as the time derivative of the altitude error. Alternatively, the rate of altitude error is taken as the rate of vertical descent from the aircraft state data 117. The required vertical acceleration (areq) is representative of the vertical acceleration required, based on a vertical descent profile model, to avoid convergence with the minimum altitude value. The required vertical acceleration calculation module 126 receives, as part of aircraft data 118 from the aircraft database 110, a vertical acceleration envelope for the aircraft 10, which is representative of performance capabilities of the aircraft 10, and compares the required vertical acceleration with the required vertical acceleration of the aircraft 10. The vertical acceleration envelope of the aircraft 10 is defined between amin (e.g., 0.03 g) and amax (e.g. 0.08 g). amax defines the minimum altitude error that can be maintained without minimum altitude intercept whereas amin defines the maximum altitude error that can be corrected to avoid minimum altitude intercept. The required vertical acceleration calculation module 126 outputs areq data 138 indicating whether the vertical acceleration required (areq) falls within the vertical acceleration performance envelope for the aircraft.

The altitude error determination module 124 and the required vertical acceleration calculation module 126 performs altitude error and areq calculations for each data point in the altitude profile defined by the aircraft predicted movement trajectory data 134. The altitude error data 136 and the areq data 138 thus provides altitude error and areq information for a distribution of data points along the planned flight path.

In embodiments, the GPWS 120 includes a minimum altitude evaluation module 132 that receives the altitude error data 136, the areq data 138, the minimum altitude type data 140 and the minimum altitude data 172 and sorts each data point into safe, caution and warning classifications. The minimum altitude evaluation module 132 decides upon a safe classification when the altitude error data 136 indicates that the aircraft predicted movement trajectory does not overlap with the minimum safe or sector altitudes. Additionally, or alternately, the minimum altitude evaluation module 132 decides upon a safe classification when the areq data 138 indicates that the required vertical acceleration is within operational limits of the aircraft 10. The minimum altitude evaluation module 132 decides upon a caution classification when the altitude error data 136 indicates that the predicted aircraft trajectory falls below the minimum safe or sector altitude. Additionally, or alternately, the minimum altitude evaluation module 132 decides upon a caution classification when the areq data 138 (generated with respect to the minimum sector or safe altitudes) indicates that the vertical acceleration of the aircraft 10 is outside of the threshold defined by amax. The minimum altitude evaluation module 132 decides upon a warning classification when the altitude error data 136 indicates that the predicted aircraft trajectory falls below the TCF value (coming from 172). Additionally, or alternately, the minimum altitude evaluation module 132 decides upon a warning classification when the areq data 138 (generated with respect to the TCF values) indicates that the vertical acceleration of the aircraft 10 is outside of the threshold defined by amax. The minimum altitude evaluation module 132 consequently outputs convergence data 142 defining a varying classification of safe, caution and warning for the forthcoming flight path.

The alert generation module 128 generates caution and warning alerts based on the convergence data 142. In particular, audible and visual alerts can be generated that distinguish caution and warning situations. The visual alerts can include a differentiation of safe, caution and warning events and also provide a spatial indication of where the minimum altitude infringement is predicted to take place. The visual alerts can include color coding to differentiate safe, caution and warning statuses. Exemplary visual alerts provided by the alert generation module 128 are described with respect to FIGS. 2 to 8. That is, the alert generation module 128, as part of the GPWS 120, provides alert output data 180 to the output system 160. The alert output data 180 sufficiently defines the form of the alert for a visual or audible alert to be issued by the display device 164 or the speaker 162 of the output system 160.

Figure 2:
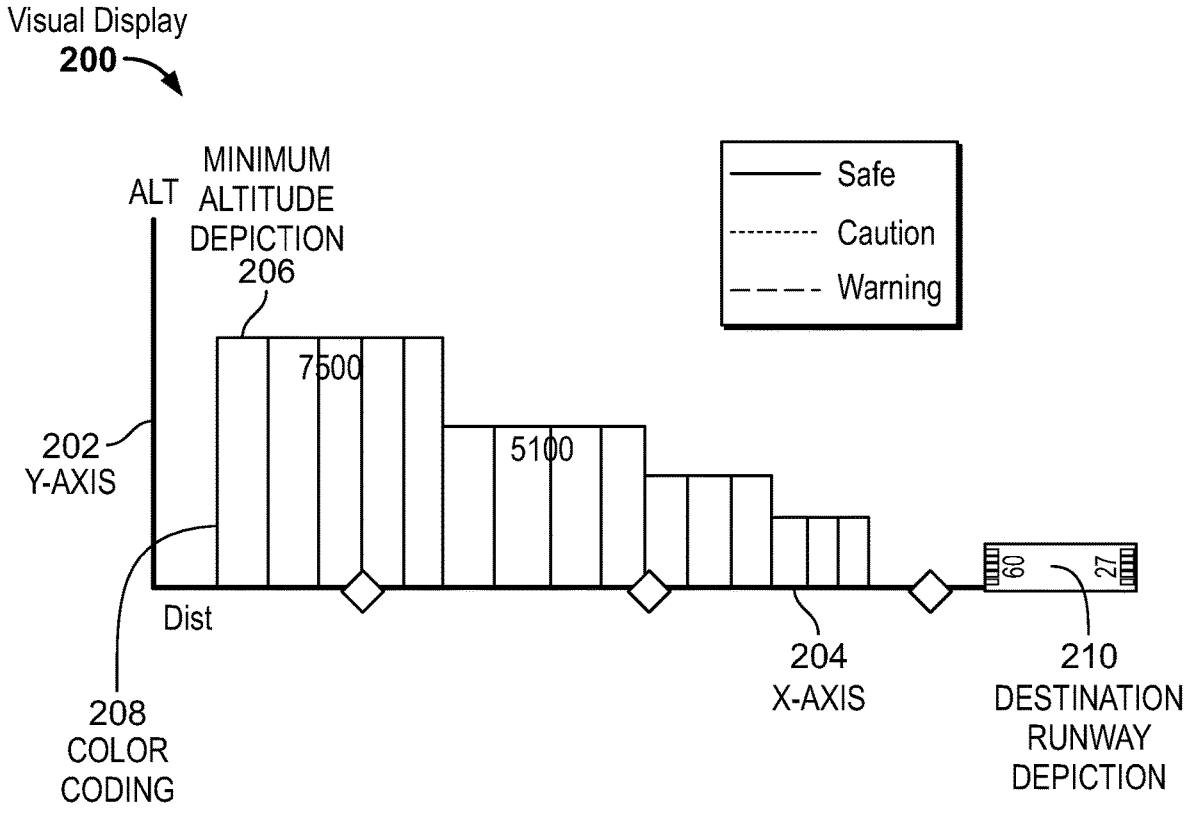
FIGS. 2 and 3 depict exemplary graphical displays including a visual alert of descent below altitude in minimum altitude format, in accordance with an exemplary embodiment.

In the example of FIG. 2, a visual display 200 generated by the alert generation module 128 is depicted. The visual display 200 provides an altitude versus distance profile with altitude on the y-axis 202 and distance on the x-axis 204. The minimum altitudes to be flown are shown in the minimum altitude depiction 206 and may correspond to the minimum safe altitude or the minimum sector altitude at that location. The minimum altitudes to be flown 206 may depict a combination of minimum safe altitudes, minimum sector altitudes and EGPWS Terrain Clearance Floor with a transition therebetween occurring as the flight plan approaches a destination runway shown by destination runway depiction 210. Other iconography can be used to represent the destination runway. The minimum altitudes are produced based on the minimum altitude data 172. The minimum altitudes 206 include color coding 208 so that safe, caution and warning classifications are visually differentiated. The color coding is generated based on the convergence data 142. Although not shown in FIG. 2, the visual display 200 may include a representation of the location of the aircraft 10 and the predicted flight path based on aircraft location data 116 and the aircraft predicted movement trajectory data 134. In the present example, the color coding 208 indicates that the minimum altitudes are not infringed by the predicted flight path of the aircraft 10.

Figure 3:
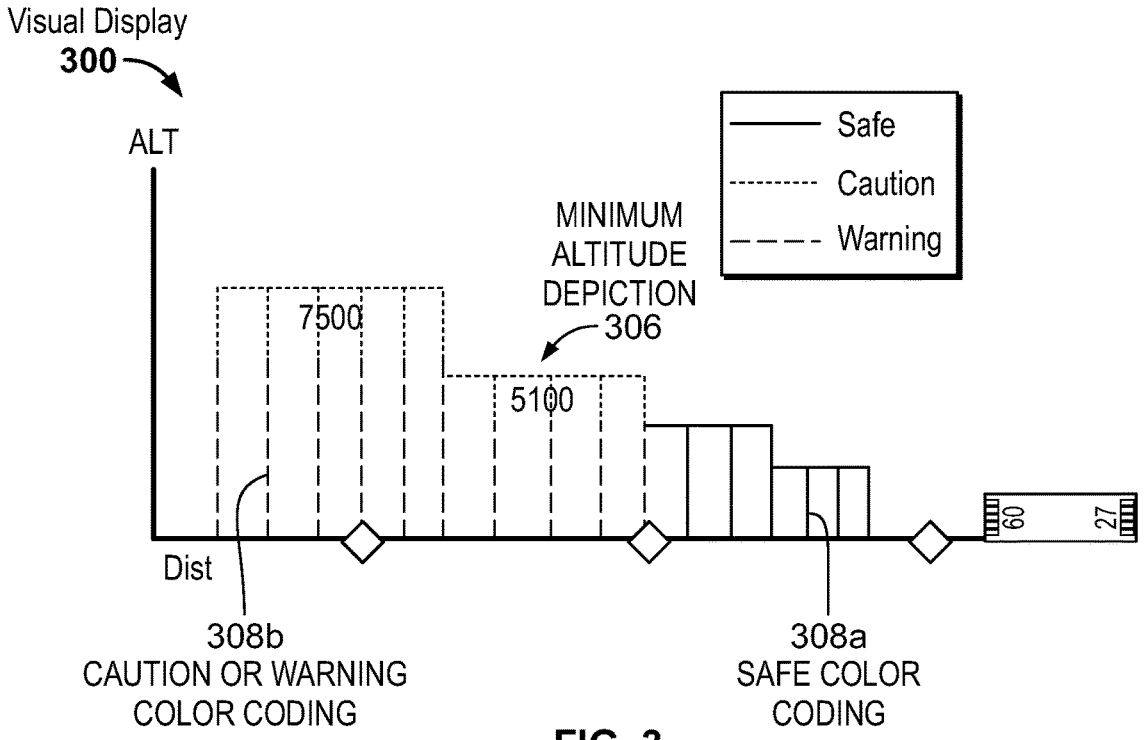

In the example of FIG. 3, the visual display 300 is the same as that of FIG. 2 except that part of the minimum altitudes included in the minimum altitude depiction 306 includes safe color coding **308*a* and part of the minimum altitudes of the minimum altitude depiction 306 includes caution or warning color coding 308*b*. This indicates that at the location corresponding to the caution or warning color coding 308*b*, the predicted trajectory of the aircraft 10 conflicts with the minimum safe/sector altitude or the TCF (warning). When conflicting with the TCF, warning color coding is provided for that part of the minimum altitudes included in the minimum altitude depiction 306 (e.g., red). When conflicting with the minimum safe/sector altitude but not the TCF, caution color coding is provided (e.g., amber). The safe color coding 308*a*** (e.g., green) is provided when no conflict with any of the minimum altitudes is predicted.

Figure 4:
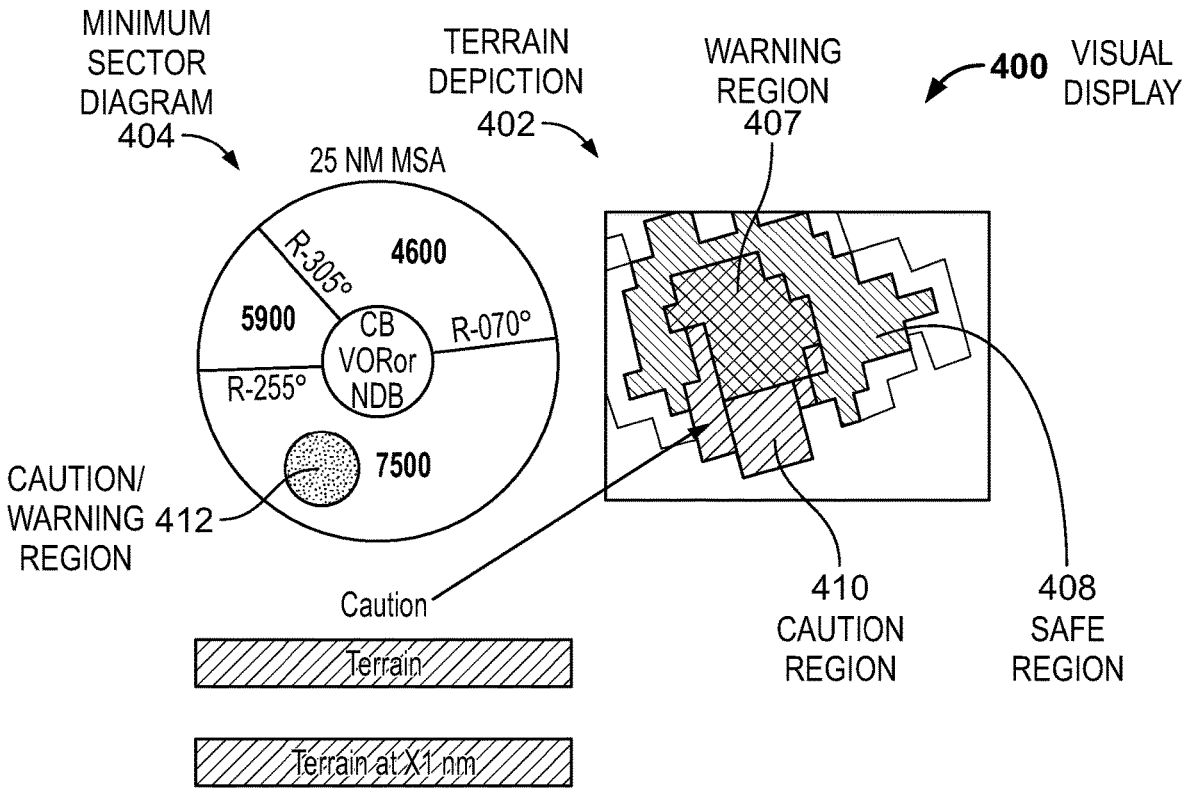
FIGS. 4 and 5 depict exemplary graphical displays including a visual alert of descent below altitude in a sector diagram and a terrain display format, in accordance with an exemplary embodiment.
Figure 5:
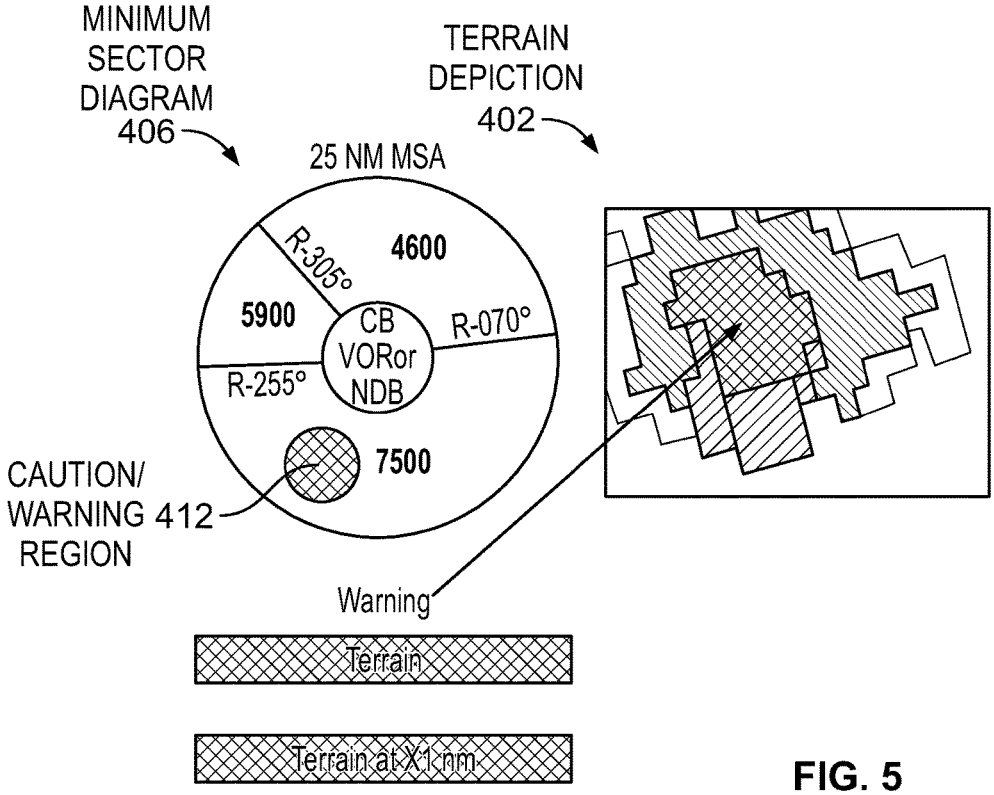

In the example of FIG. 4, a visual display 400 is provided that combines a terrain depiction 402 and a minimum sector diagram 404. It should be appreciated that one or the other of the minimum sector diagram 404 and the terrain depiction 402 can be displayed. The minimum sector diagram 404 can include a reference point (VOR, NDB, DME, etc.), one or several sectors and a graphical depiction of altitude that allows adequate vertical clearance from nearby terrain and man-made obstacles, allowing proper navigational functions. The minimum sector diagram 404 is supplemented with a graphical depiction of a caution/warning region, which provides a spatially representative depiction of where the GPWS 120 predicts a conflict with minimum safe/sector altitude value. The caution/warning region 412 is color-coded differently to illustrate a caution alert (see FIG. 4) and to illustrate a warning alert (see FIG. 5). The terrain depiction 402 includes color-coded terrain/obstacle indications to differentiate safe regions 408, caution regions 410 and warning regions 407 as predicted by the GPWS 120 relative to the planned flight path.

Figure 6:
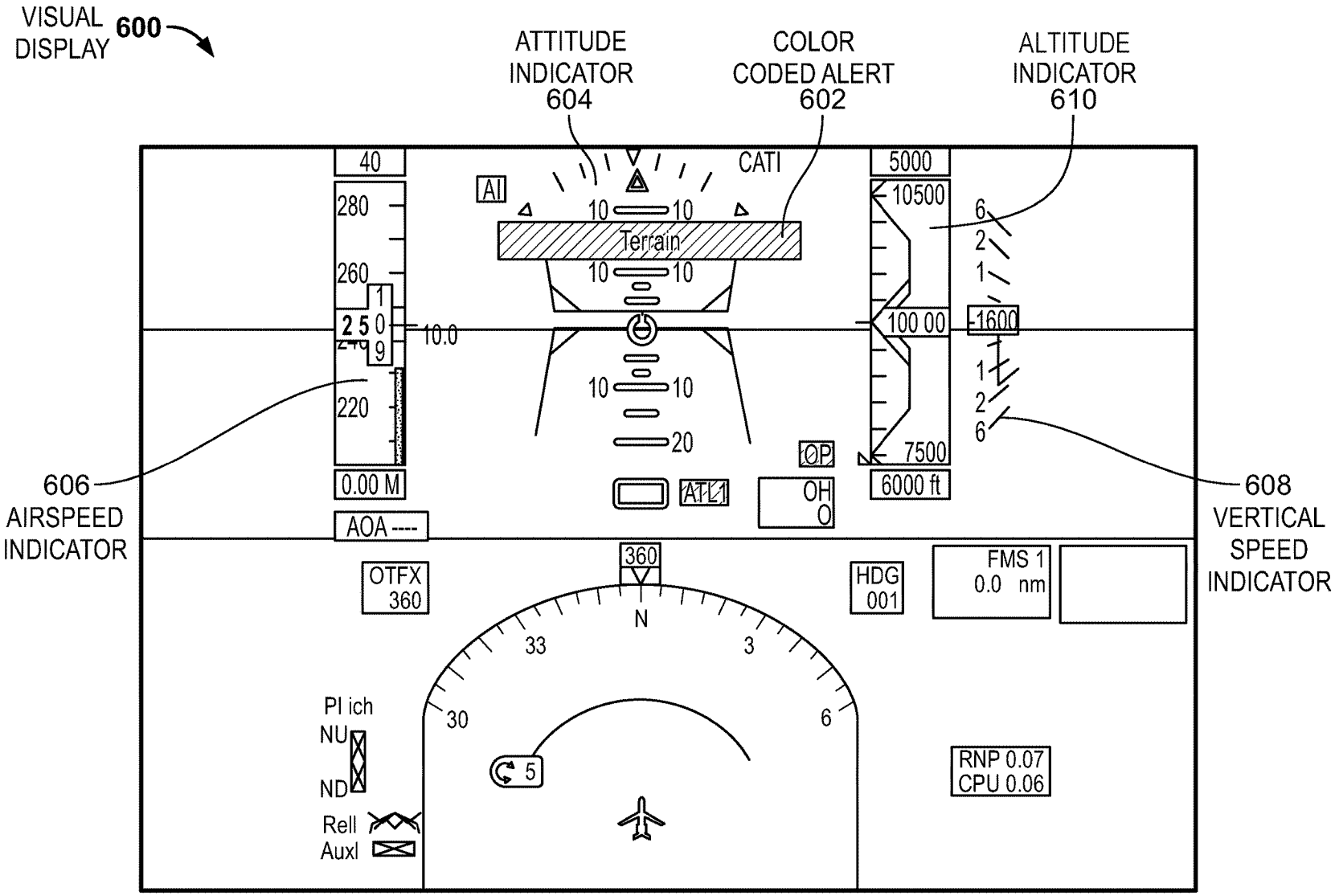
FIG. 6 depicts an exemplary graphical displays including an alert of descent below altitude in a primary flight display format, in accordance with an exemplary embodiment.

In the example of FIG. 6, the visual display 600 is provided as part of a primary flight display that includes an attitude indicator 604, which gives the pilot information about the pitch and roll characteristics of the aircraft 10, and the orientation of the aircraft 10 with respect to the horizon. The primary flight display may further include airspeed, vertical speed and altitude indicators 606, 608, 610, respectively. The visual display 600 further includes a color-coded alert 602 that provides an indication when caution and warning events are predicted by the GPWS 120. The color-coded alert 602 can differentiate caution and warning events and may include textual information about the nature of the alert, e.g. "TERRAIN".

In the example of FIG. 7, another visual display 700 is depicted that may be output through the display device 164. The visual display 700 includes minimum altitudes to be flown as shown by the minimum altitude depiction 702, as described with respect to FIGS. 2 and 3. Further, an aircraft indication 711 is provided as well as a depiction of the planned vertical profile 706 according to the FMS predicted trajectories data 114. For understanding purposes, an unsafe aircraft forward predicted trajectory (or an unsafe aircraft predicted movement trajectory) 708 is depicted, which represents a predicted aircraft trajectory conflicting with the minimum altitudes shown by the minimum altitude depiction 702. In such a case, the minimum altitudes included in the minimum altitude depiction 702 include color coding indicating caution or warning alerts for parts of the aircraft predicted movement trajectory profile 708 that ingresses on the respective minimum altitude (minimum sector/safe altitude and TCF). For understanding purposes, a safe aircraft forward predicted trajectory profile 710 is also illustrated, which does not conflict with the respective minimum altitudes, which would result in the minimum altitudes included in the minimum altitude depiction 702 including safe color coding. In the example of FIG. 7, the following events could occur. The aircraft 10 could be descending in vertical manual guidance mode by which the pilot manages the descent. The pilot may take a course as indicated by the unsafe trajectory profile 708, which results in a caution alert by way of color coding in the minimum altitudes included in the minimum altitude depiction 702, an audible alert and possibly other visual alerts as described with respect to FIGS. 4 to 6. In response, the pilot may switch to a vertical speed manual mode by which the aircraft 10 maintains a vertical speed through an autopilot system. The vertical speed will be set so as to avoid the minimum altitudes shown by the minimum altitude depiction 702, whereby the aircraft 10 follows the safe aircraft predicted trajectory 710. The target runway depiction 704 is merely exemplary and can be replaced with other iconography.

Figure 8:
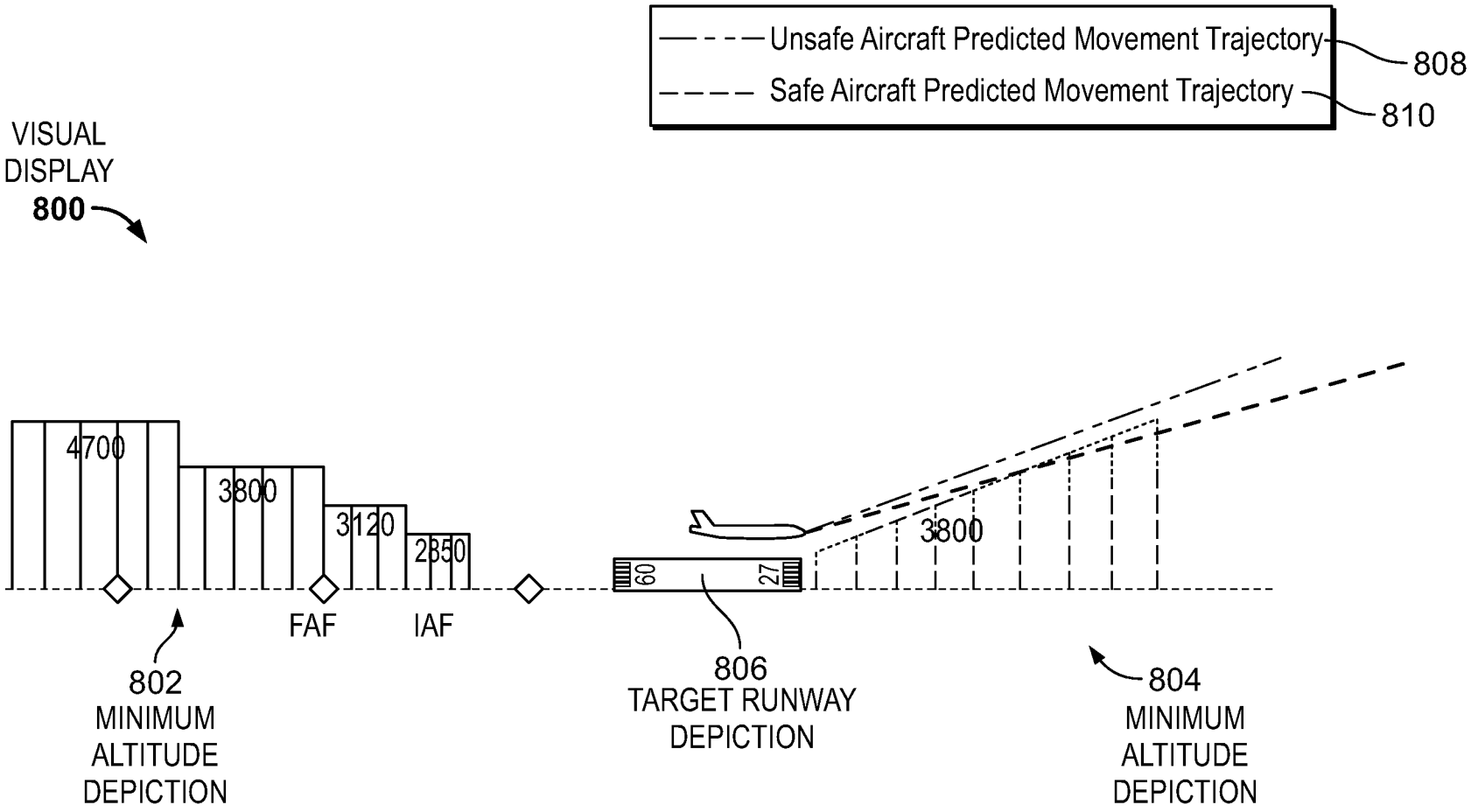
FIG. 8 depicts an exemplary graphical display including a visual alert of descent below altitude in minimum altitude format, in accordance with an exemplary embodiment

In the example of FIG. 8, the GPWS 120 provides a visual display 800 in a go-around event. The visual display 800 includes a minimum altitude depiction 802 that indicates, through color coding, safe descent altitudes with respect to the minimum altitude values and a minimum ascent altitude 804 that indicates a warning or caution profile through color coding. Assuming that the aircraft 10 is climbing in vertical manual guidance mode along an unsafe trajectory profile 810, the pilot may react to the predictive warning or caution ascent profile by switching to a vertical speed mode that avoids the impingement upon the minimum altitude values according to the safe aircraft predicted trajectory profile 808. The visual display includes a target runway depiction 806. It should be appreciated that the form of the depiction of the target runway is notional and may be presented in other ways.

Figure 9:
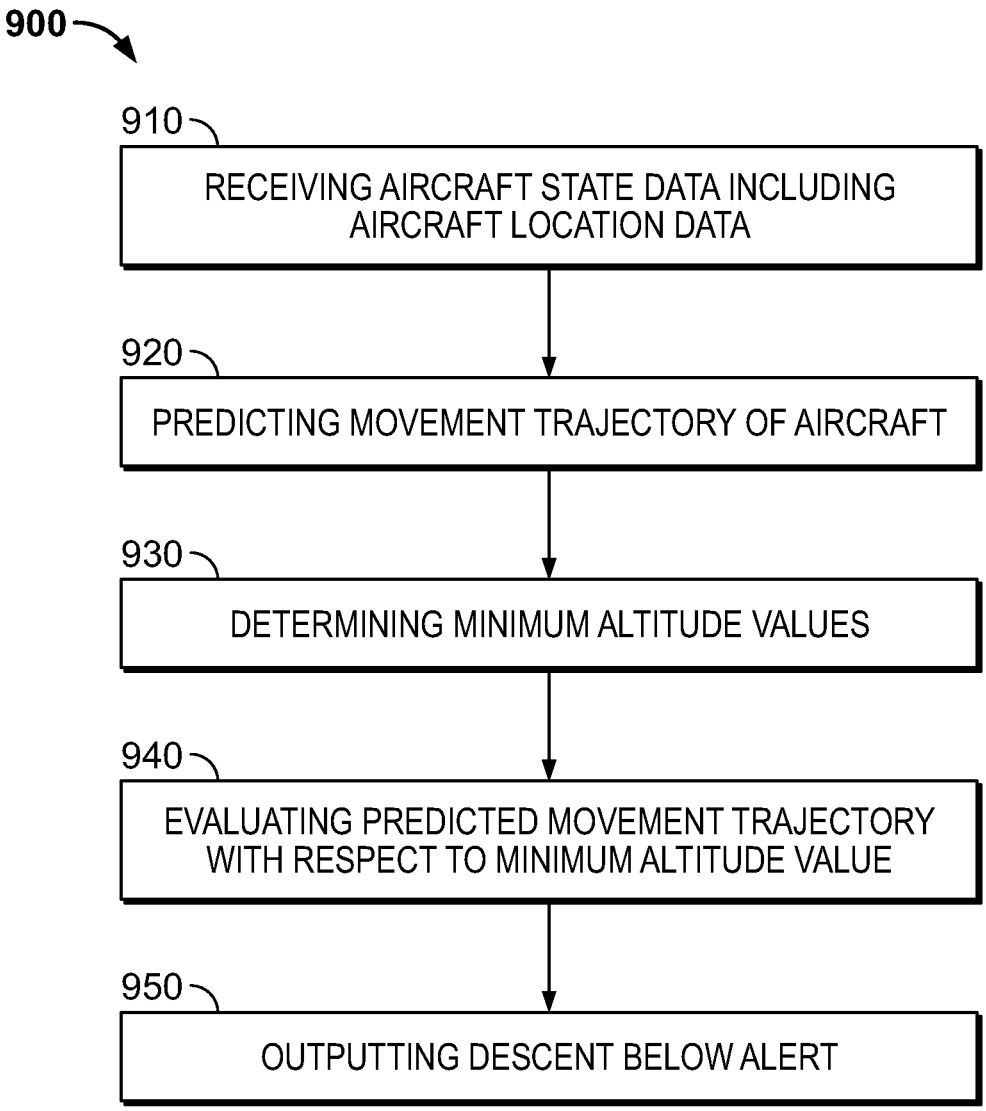
FIG. 9 is a flowchart of a method for providing descent below altitude alerts, in accordance with an embodiment.

A flow chart of an exemplary method 900 of generating descent below altitude alerts is provided in FIG. 9. The method 900 is computer implemented by the processing system 1006 of FIG. 10, specifically by the various modules of the GPWS of FIG. 1 that are executed by the processing system 1006 of FIG. 10.

The method 900 includes step 910 of receiving aircraft state data including aircraft location data 116 representing a location of the aircraft 10. In addition, a flight plan may be received from the FMS 108. In step 920, a movement trajectory of the aircraft 10 is predicted. The movement trajectory is predicted based on the location of the aircraft 10 and aircraft state data 117 and may additionally be generated to follow the flight plan from the FMS 108. The aircraft predicted movement trajectory may model a vertical descent profile based on a vertical acceleration of the aircraft 10 included in the aircraft state data 117. In step 930, minimum altitude values are determined for the aircraft predicted movement trajectory. That is, minimum altitude values available in reference data 112 from the terrain and obstacle database 104 and/or from the database of digital charts 102 that apply to the predicted flight plan are obtained. The minimum altitudes include minimum safe altitude values and minimum sector altitude values. A transition occurs from use of minimum safe altitude values to minimum sector altitude values based on distance from a target runway. Further, TCF minimum altitude values are obtained. Accordingly, profiles of minimum safe/sector altitude values and TCF values are determined, and a predicted trajectory profile is determined. In step 940, the aircraft predicted movement trajectory and the minimum altitude profiles are evaluated to determine whether an alert should be issued. Step 940 may include determining an altitude error between the predicted trajectory profile and the minimum altitude profile. Step 940 may additionally, or alternately, include determining a required vertical acceleration (based on a curved descent profile model) to correct for the altitude error and assessing whether the required vertical acceleration complies with operational limits of the aircraft 10. Step 940 encompasses a comparison of minimum altitudes (minimum safe or sector altitudes or TCF) along the route with the altitudes that will be achieved based on the aircraft predicted movement trajectory provided by step 940. In step 950, a descent below alert is output in response to the evaluation of step 940. That is, if either of the evaluation methods (required vertical acceleration and altitude error) result in a prediction that the aircraft 10 will infringe the minimum altitude values, then a corresponding alert is issued. That is, when the minimum safe/sector altitudes are predicted to be breached, caution alerts are issued and when the TCF is predicted to be breached, warning alerts are issued. In accordance with the present disclosure, the caution and warning alert predictions are spatially mapped in a visual display and may be accompanied by an indication of predicted adherence to the minimum altitude values in the form of a safe indication. Color coding is used as part of the visual displays to differentiate safe, caution and warning statuses.

Figure 10:
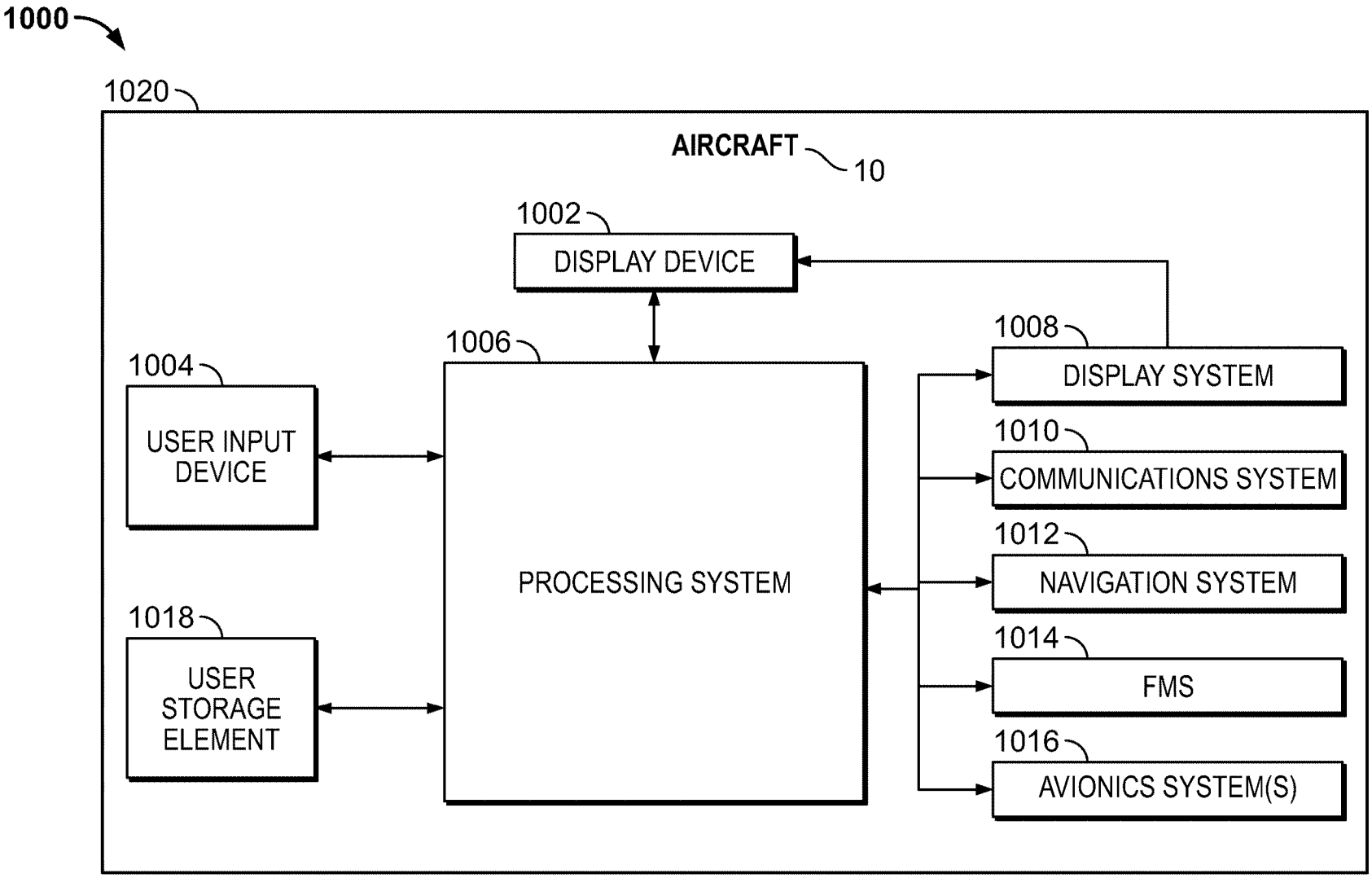
FIG. 10 depicts an exemplary embodiment of an aircraft system suitable for implementing the systems and methods for providing descent below altitude alerts, in accordance with one or more embodiments.

FIG. 10 depicts an exemplary embodiment of an aircraft system 1000 suitable for implementing the descent below alerts described herein. The illustrated aircraft system 1000 (corresponding to system 100 of FIG. 1) includes, without limitation, a display device 1002 (corresponding to display device 164 of FIG. 1), one or more user input devices 1004, a processing system 1006 (for implementing functions and methods described herein with respect to system 100), a communications system 1010, a navigation system 1012, a flight management system (FMS) 1014 (corresponding to the FMS 108 of FIG. 1), one or more avionics systems 1016, and a data storage element 1018 (suitably configured to support operation of the system 1000.

In exemplary embodiments, the display device 1002 is realized as an electronic display capable of graphically displaying flight information or other data associated with operation of the aircraft 1020 under control of the display system 1008 and/or processing system 1006. In this regard, the display device 1002 is coupled to the display system 1008 and the processing system 1006, wherein the processing system 1006 and the display system 1008 are cooperatively configured to display, render, or otherwise convey one or more graphical representations or images associated with operation of the aircraft 1020 on the display device 1002. The user input device 1004 is coupled to the processing system 1006, and the user input device 1004 and the processing system 1006 are cooperatively configured to allow a user (e.g., a pilot, co-pilot, or crew member) to interact with the display device 1002 and/or other elements of the system 1000, as described herein. Depending on the embodiment, the user input device(s) 1004 may be realized as a keypad, touchpad, keyboard, mouse, touch panel (or touchscreen), joystick, knob, line select key or another suitable device adapted to receive input from a user. In some embodiments, the user input device 1004 includes or is realized as an audio input device, such as a microphone, audio transducer, audio sensor, or the like, that is adapted to allow a user to provide audio input to the system 1000 in a "hands free" manner without requiring the user to move his or her hands, eyes and/or head to interact with the system 1000.

The processing system 1006 generally represents the hardware, software, and/or firmware components configured to facilitate communications and/or interaction between the elements of the aircraft system 1000 and perform additional tasks and/or functions to support the various modules GPWS 120 of FIG. 1 during operation of the aircraft system 1000, as described herein. Depending on the embodiment, the processing system 1006 may be implemented or realized with a general-purpose processor, a content addressable memory, a digital signal processor, an application specific integrated circuit, a field programmable gate array, any suitable programmable logic device, discrete gate or transistor logic, processing core, discrete hardware components, or any combination thereof, designed to perform the functions described herein. The processing system 1006 may also be implemented as a combination of computing devices, e.g., a plurality of processing cores, a combination of a digital signal processor and a microprocessor, a plurality of microprocessors, one or more microprocessors in conjunction with a digital signal processor core, or any other such configuration. In practice, the processing system 1006 includes processing logic that may be configured to carry out the functions, techniques, and processing tasks associated with the operation of the aircraft system 1000, as described herein. Furthermore, the steps of a method or algorithm described in connection with the embodiments disclosed herein may be embodied directly in hardware, in firmware, in a software module executed by the processing system 1006, or in any practical combination thereof. For example, in one or more embodiments, the processing system 1006 includes or otherwise accesses a data storage element 1018 (or memory), which may be realized as any sort of non-transitory short- or long-term storage media capable of storing programming instructions for execution by the processing system 1006. The code or other computer-executable programming instructions, when read and executed by the processing system 1006, cause the processing system 1006 to support or otherwise perform certain tasks, operations, and/or functions described herein in the context of the flight rules alerts. Depending on the embodiment, the data storage element 1018 may be physically realized using RAM memory, ROM memory, flash memory, registers, a hard disk, or another suitable data storage medium known in the art or any suitable combination thereof.

The display system 1008 generally represents the hardware, software, and/or firmware components configured to control the display and/or rendering of one or more navigational maps and/or other displays pertaining to operation of the aircraft 1020 and/or onboard systems 1010, 1012, 1014, 1016 on the display device 1002. In this regard, the display system 1008 may access or include one or more databases suitably configured to support operations of the display system 1008, such as, for example, a terrain database, an obstacle database, a navigational database, a geopolitical database, a terminal airspace database, a special use airspace database, or other information for rendering and/or displaying navigational maps and/or other content on the display device 1002.

Still referring to FIG. 10, in an exemplary embodiment, the processing system 1006 is coupled to the navigation system 1012, which is configured to provide real-time navigational data and/or information regarding operation of the aircraft 1020. The navigation system 1012 may be realized as a global navigation satellite system (e.g., a global positioning system (GPS), a ground-based augmentation system (GBAS), a satellite-based augmentation system (SBAS), and/or the like), inertial reference system (IRS), or a radio-based navigation system (e.g., VHF omni-directional radio range (VOR) or long range aid to navigation (LORAN)), and may include one or more navigational radios or other sensors suitably configured to support operation of the navigation system 1012, as will be appreciated in the art. The navigation system 1012 is capable of obtaining and/or determining the instantaneous position of the aircraft 1020, that is, the current (or instantaneous) location of the aircraft 1020 (e.g., the current latitude and longitude) and the current (or instantaneous) altitude or above ground level for the aircraft 1020. The navigation system 1012 is also capable of obtaining or otherwise determining the heading of the aircraft 1020 (i.e., the direction the aircraft is traveling in relative to some reference). In the illustrated embodiment, the processing system 1006 is also coupled to the communications system 1010, which is configured to support communications to and/or from the aircraft 1020. For example, the communications system 1010 may support communications between the aircraft 1020 and air traffic control or another suitable command center or ground location. In this regard, the communications system 1010 may be realized using a radio communication system and/or another suitable data link system.

In an exemplary embodiment, the processing system 1006 is also coupled to the FMS 1014, which is coupled to the navigation system 1012, the communications system 1010, and one or more additional avionics systems 1016 to support navigation, flight planning, and other aircraft control functions in a conventional manner, as well as to provide real-time data and/or information regarding the operational status of the aircraft 1020 to the processing system 1006. Although FIG. 10 depicts a single avionics system 1016, in practice, the aircraft system 1000 and/or aircraft 1020 will likely include numerous avionics systems for obtaining and/or providing real-time flight-related information that may be displayed on the display device 1002 or otherwise provided to a user (e.g., a pilot, a co-pilot, or crew member). For example, practical embodiments of the aircraft system 1000 and/or aircraft 1020 will likely include one or more of the following avionics systems suitably configured to support operation of the aircraft 1020: a weather system, an air traffic management system, a radar system, a traffic avoidance system, an autopilot system, an autothrust system, a flight control system, hydraulics systems, pneumatics systems, environmental systems, aircraft systems, engine systems, trim systems, lighting systems, crew alerting systems, electronic checklist systems, an electronic flight bag and/or another suitable avionics system. In various embodiments, the processing system 1006 may obtain information pertaining to the current location and/or altitude of the aircraft 1020 and/or other operational information characterizing or otherwise describing the current operational context or status of the aircraft 1020 from one or more of the onboard systems 1008, 1010, 1012, 1014, 1016.

It should be understood that FIG. 10 is a simplified representation of the aircraft system 1000 for purposes of explanation and ease of description, and FIG. 10 is not intended to limit the application or scope of the subject matter described herein in any way. It should be appreciated that although FIG. 10 shows the various elements of the system 1000 being located onboard the aircraft 1020 (e.g., in the cockpit), in practice, one or more of the elements of the system 1000 may be located outside the aircraft 1020 (e.g., on the ground as part of an air traffic control center or another command center) and communicatively coupled to the remaining elements of the aircraft system 1000 (e.g., via a data link and/or communications system 1010). For example, in some embodiments, the data storage element 1018 may be located outside the aircraft 1020 and communicatively coupled to the processing system 1006 via a data link and/or communications system 1010. Furthermore, practical embodiments of the aircraft system 1000 and/or aircraft 1020 will include numerous other devices and components for providing additional functions and features, as will be appreciated in the art. In this regard, it will be appreciated that although FIG. 10 shows a single display device 1002, in practice, additional display devices may be present onboard the aircraft 1020. Additionally, it should be noted that in other embodiments, features and/or functionality of processing system 1006 described herein can be implemented by or otherwise integrated with the features and/or functionality provided by the FMS 1014. In other words, some embodiments may integrate the processing system 1006 with the FMS 1014. In yet other embodiments, various aspects of the subject matter described herein may be implemented by or at an electronic flight bag (EFB) or similar electronic device that is communicatively coupled to the processing system 506 and/or the FMS 1014.

For the sake of brevity, conventional techniques related to sensors, statistics, data analysis, avionics systems, redundancy, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The subject matter may be described herein in terms of functional and/or logical block components, and with reference to symbolic representations of operations, processing tasks, and functions that may be performed by various computing components or devices. It should be appreciated that the various block components shown in the figures may be realized by any number of hardware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices. Furthermore, embodiments of the subject matter described herein can be stored on, encoded on, or otherwise embodied by any suitable non-transitory computer-readable medium as computer-executable instructions or data stored thereon that, when executed (e.g., by a processing system), facilitate the processes described above.

The foregoing description refers to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements directly connected to one another, additional intervening elements, devices, features, or components may be present in an embodiment of the depicted subject matter. In addition, certain terminology may also be used herein for the purpose of reference only, and thus are not intended to be limiting.

The foregoing detailed description is merely exemplary in nature and is not intended to limit the subject matter of the application and uses thereof. Furthermore, there is no intention to be bound by any theory presented in the preceding background, brief summary, or the detailed description.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment of the subject matter. It should be understood that various changes may be made in the function and arrangement of elements described in an exemplary embodiment without departing from the scope of the subject matter as set forth in the appended claims. Accordingly, details of the exemplary embodiments or other limitations described above should not be read into the claims absent a clear intention to the contrary.

What is claimed is:

1. A method for alerting descent with respect to at least one of minimum sector altitude and minimum safe altitude in an aircraft, the method comprising:

determining, via at least one processor, a distance between a location of the aircraft and a navigation aid;

deciding, via the at least one processor, to perform an evaluation using a minimum safe altitude value when the distance is greater than a pre-defined distance with respect to the navigational aid and transitioning to perform the evaluation using a minimum sector altitude value as the distance falls below the pre-defined distance;

receiving, via the at least one processor, the decided one of the minimum sector altitude value or the minimum safe altitude value;

predicting, via the at least one processor, an aircraft predicted movement trajectory of the aircraft;

evaluating, via the at least one processor, the aircraft predicted movement trajectory with respect to the decided one of the minimum sector altitude value or the minimum safe altitude value; and outputting an alert, via an output system, when the evaluation predicts convergence of the aircraft predicted movement trajectory and the decided one of the minimum sector altitude value or the minimum safe altitude value.

2. The method of claim 1, wherein predicting the aircraft predicted movement trajectory of the aircraft is based on modeling a vertical profile using vertical acceleration of the aircraft.

3. The method of claim 1, wherein predicting the aircraft predicted movement trajectory of the aircraft comprises:

receiving, via the at least one processor, a rate of descent of the aircraft;

using the rate of descent of the aircraft, projecting, via the at least one processor, an altitude of the aircraft at a plurality of points along the aircraft predicted movement trajectory; and receiving, via at least one processor, at least one of a minimum sector altitude value, a minimum safe altitude value and a terrain clearance floor value for each of the plurality of points along the aircraft predicted movement trajectory;

wherein evaluating the aircraft predicted movement trajectory comprises:

comparing, via the at least one processor, the altitude of the aircraft at each of the plurality of points with the at least one of the minimum sector altitude value, the minimum safe altitude value and the terrain clearance floor value.

4. The method of claim 3, wherein evaluating the aircraft predicted movement trajectory comprises determining an altitude error based on a difference between the altitude of the aircraft at each of the plurality of points and the at least one of the minimum sector altitude value, the minimum safe altitude value and the terrain clearance floor value.

5. The method of claim 4, comprising determining, via the at least one processor, a vertical acceleration required to avoid convergence of the aircraft predicted movement trajectory and the at least one of the minimum sector altitude value, the minimum safe altitude value and the terrain clearance floor value based on the rate of descent of the aircraft and the altitude error at each of the plurality of points, wherein evaluating the aircraft predicted movement trajectory comprises comparing the vertical acceleration required with vertical acceleration operational limits of the aircraft.

6. The method of claim 1, wherein predicting the aircraft predicted movement trajectory of the aircraft comprises:

receiving, via the at least one processor, an altitude of the aircraft at a plurality of points along the aircraft predicted movement trajectory from a Flight Management System (FMS) of the aircraft; and receiving, via at least one processor, at least one of the minimum sector altitude value, the minimum safe altitude value and a terrain clearance floor value for each of the plurality of points along the aircraft predicted movement trajectory;

wherein evaluating the aircraft predicted movement trajectory comprises:

comparing, via the at least one processor, the altitude of the aircraft at each of the plurality of points with the at least one of the minimum sector altitude value, the minimum safe altitude value and the terrain clearance floor value.

7. The method of claim 6, wherein evaluating the aircraft predicted movement trajectory comprises determining an altitude error based on a difference between the altitude of the aircraft at each of the plurality of points and the at least one of the minimum sector altitude value, the minimum safe altitude value and the terrain clearance floor value.

8. The method of claim 7, comprising determining, via the at least one processor, a vertical acceleration required to avoid convergence of the aircraft predicted movement trajectory and the at least one of the minimum sector altitude value, the minimum safe altitude value and the terrain clearance floor value based on a rate of descent of the aircraft and the altitude error at each of the plurality of points, wherein evaluating the aircraft predicted movement trajectory comprises comparing the vertical acceleration required with vertical acceleration operational limits of the aircraft.

9. The method of claim 1, wherein outputting the alert includes outputting, via a display system of the output system, a visual indicator and/or outputting an aural alert via a speaker of the output system.

10. The method of claim 9, wherein the visual indicator is coded to indicate a safe status when the evaluation predicts no convergence of the aircraft predicted movement trajectory with the at least one of the minimum sector altitude value, the minimum safe altitude value and a terrain clearance floor value and to indicate an advisory, caution or warning status when the evaluation predicts convergence of the aircraft predicted movement trajectory and the at least one of the minimum sector altitude value, the minimum safe altitude value and the terrain clearance floor value.

11. The method of claim 10, wherein the visual indicator is coded to indicate a safe status when the evaluation predicts no convergence of the aircraft predicted movement trajectory with the at least one of the minimum sector altitude value, the minimum safe altitude value and the terrain clearance floor value, to indicate a caution status when the evaluation predicts convergence of the aircraft predicted movement trajectory and the minimum safe altitude value or the minimum sector altitude value and to indicate a warning status when the evaluation predicts convergence of the aircraft predicted movement trajectory and the terrain clearance floor value.

12. The method of claim 1, comprising deciding, via the at least one processor, whether to perform the evaluation with respect to minimum sector altitude or the minimum safe altitude based on a flight plan of the aircraft.

13. A system for alerting descent with respect to at least one of minimum sector altitude and a minimum safe altitude in an aircraft, the system comprising:

an output system;

at least one processor in operable communication with the output device, the processor configured to execute program instructions, wherein the program instructions are configured to cause the processor to:

predict an aircraft predicted movement trajectory of the aircraft, the movement trajectory including a plurality of spaced locations;

determine a distance between each of the plurality of spaced locations and a navigation aid;

decide to perform an evaluation using a minimum safe altitude value for each of the plurality of spaced locations where the distance associated with the spaced location is greater than a pre-defined distance with respect to the navigational aid and transition to perform the evaluation using a minimum sector altitude value for each of the plurality of spaced locations where the distance associated with the spaced location falls below the pre-defined distance;

receive the decided one of the minimum sector altitude value and the minimum safe altitude value for each of the plurality of spaced locations of the movement trajectory;

evaluate the aircraft predicted movement trajectory with respect to the decided one of the minimum sector altitude value or the minimum safe altitude value at each of the plurality of spaced location of the movement trajectory; and output an alert, via the output system, when the evaluation predicts convergence of the aircraft predicted movement trajectory and the decided one of the minimum sector altitude value or the minimum safe altitude value with respect to at least one of the plurality of spaced locations.

14. The system of claim 13, wherein predicting the aircraft predicted movement trajectory of the aircraft is based on aircraft state data and is performed, at least partly, by a Flight Management System (FMS) of the aircraft.

15. The system of claim 13, wherein the alert includes a visual alert indicating convergence and lack of convergence at each of the plurality of spaced locations.

16. The system of claim 13, wherein the alert includes a visual indicator that is coded to indicate a safe status when the evaluation predicts no convergence of the aircraft predicted movement trajectory with the at least one of the minimum sector altitude value, the minimum safe altitude value and a terrain clearance floor value, to indicate a caution status when the evaluation predicts convergence of the aircraft predicted movement trajectory and the minimum safe altitude value or the minimum sector altitude value and to indicate a warning status when the evaluation predicts convergence of the aircraft predicted movement trajectory and the terrain clearance floor value.

17. The system of claim 13, wherein the alert includes a visual alert included in an altitude profile depicting the at least one of the minimum sector altitude value, the minimum safe altitude value and a terrain clearance floor value at a plurality of locations along the flight plan, wherein the altitude profile is color- and/or texture-coded to indicate convergence and non-convergence of the aircraft predicted movement trajectory and the at least one of the minimum sector altitude value, the minimum safe altitude value and the terrain clearance floor value, and wherein the altitude profile includes a depiction of the flight plan or the aircraft predicted movement trajectory.

18. The system of claim 13, wherein the alert includes a visual alert included in a minimum sector altitude diagram included a color- and/or texture-coded region indicating where the evaluation predicts convergence of the aircraft predicted movement trajectory and the at least one of the minimum sector altitude value, the minimum safe altitude value and a terrain clearance floor value.

19. The system of claim 13, wherein the alert includes a visual alert included in a terrain display including a color- and/or texture-coded region indicating where the evaluation predicts convergence of the aircraft predicted movement trajectory and the at least one of the minimum sector altitude value, the minimum safe altitude value and a terrain clearance floor value.

20. The system of claim 13, wherein the alert is a visual alert included in a primary flight display.

* * * * *